US011710453B2

(12) United States Patent
Lee et al.

(10) Patent No.: US 11,710,453 B2
(45) Date of Patent: Jul. 25, 2023

(54) PIXEL CIRCUIT, DISPLAY DEVICE INCLUDING THE SAME, AND METHOD OF DRIVING PIXEL CIRCUIT

(71) Applicant: Samsung Display Co., LTD., Yongin-si (KR)

(72) Inventors: Chang-Soo Lee, Suwon-si (KR); Boyong Chung, Suwon-si (KR); Jonghee Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/490,153

(22) Filed: Sep. 30, 2021

(65) Prior Publication Data

US 2022/0130334 A1 Apr. 28, 2022

(30) Foreign Application Priority Data

Oct. 26, 2020 (KR) ..... 10-2020-0139723

(51) Int. Cl.
*G09G 3/3241* (2016.01)
*G09G 3/3291* (2016.01)

(52) U.S. Cl.
CPC ..... *G09G 3/3241* (2013.01); *G09G 3/3291* (2013.01); *G09G 2300/0842* (2013.01)

(58) Field of Classification Search
CPC .. G09G 3/3233; G09G 3/3266; G09G 3/3258; G09G 3/3291; G09G 3/3225; G09G 3/3208; G09G 2300/0819; G09G 2300/0861; G09G 2300/0842; G09G 2300/0426; G09G 2320/0233; G09G 2320/043; G09G 2320/045; G09G 2320/0223; G09G 2310/0251; G09G 2310/061; G09G 2310/0262
See application file for complete search history.

(56) References Cited

U.S. PATENT DOCUMENTS

| | | | |
|---|---|---|---|
| 9,137,741 B2 | 9/2015 | Park et al. | |
| 10,930,215 B2 | 2/2021 | Xu | |
| 11,087,688 B2 | 8/2021 | Lin et al. | |
| 2011/0205206 A1* | 8/2011 | Yoo | G09G 3/3275 345/82 |

(Continued)

FOREIGN PATENT DOCUMENTS

| | | |
|---|---|---|
| CN | 107016964 | 8/2017 |
| JP | 2020-518840 | 6/2020 |

(Continued)

*Primary Examiner* — Dong Hui Liang
(74) *Attorney, Agent, or Firm* — H.C. Park & Associates, PLC

(57) ABSTRACT

A pixel circuit including an organic light emitting diode, a first transistor configured to drive the organic light emitting diode, a second transistor electrically connected between a gate node of the first transistor and a data line, a third transistor electrically connected between a source node of the first transistor and an initialization voltage line and a storage capacitor electrically connected between the gate node and the source node of the first transistor. In a data writing period in which the storage capacitor is charged with electric charges, a turn-off time of the third transistor lags compared to a turn-off time of the second transistor.

14 Claims, 7 Drawing Sheets

(56) References Cited

U.S. PATENT DOCUMENTS

| | | | | |
|---|---|---|---|---|
| 2012/0098810 | A1* | 4/2012 | Nieh | G09G 3/3233 345/76 |
| 2018/0039107 | A1* | 2/2018 | Sasaki | G09G 3/3607 |
| 2018/0233085 | A1* | 8/2018 | Wang | G09G 3/3233 |
| 2019/0164481 | A1* | 5/2019 | Yuan | H01L 27/3265 |
| 2019/0189056 | A1* | 6/2019 | Gai | G09G 3/3233 |
| 2020/0226983 | A1* | 7/2020 | Lee | H01L 27/3276 |
| 2020/0320930 | A1* | 10/2020 | Toyotaka | H01L 27/3262 |
| 2021/0225271 | A1* | 7/2021 | Jang | G09G 3/3233 |

FOREIGN PATENT DOCUMENTS

| | | |
|---|---|---|
| KR | 10-1430473 | 8/2014 |
| KR | 10-2136263 | 7/2020 |

* cited by examiner

PIXEL CIRCUIT, DISPLAY DEVICE INCLUDING THE SAME, AND METHOD OF DRIVING PIXEL CIRCUIT

CROSS REFERENCE TO RELATED APPLICATION

This application claims priority from and the benefit of Korean Patent Application No. 10-2020-0139723 filed on Oct. 26, 2020, which is hereby incorporated by reference for all purposes as if fully set forth herein.

BACKGROUND

Field

Embodiments of the invention relate generally to a pixel circuit, a display device including the same, and a method of driving a pixel circuit. More particularly, embodiments of the invention relate to a pixel circuit, a display device including the same, and a method of driving a pixel circuit, in which an initialization signal is turned off later than a scan signal by reflecting a time delay of the initialization signal.

Discussion of the Background

In general, a display device includes a display panel and a display panel driver. The display panel includes a plurality of gate lines and a plurality of data lines. The display panel driver includes a gate driver configured to provide a gate signal to the gate lines and a data driver configured to provide a data voltage to the data lines.

The display panel includes a plurality of pixel circuits. Each of the pixel circuits performs charging and light-emitting operations through predetermined steps. A transistor in each of the pixel circuits on the display panel may not be sufficiently charged because of a signal transmission error caused by an RC delay and a clock jitter (or CK jitter) inside the pixel circuit. In this case, a light emitting element inside the pixel circuit may not emit light sufficiently, so that an image quality defect, such as a horizontal stripe, may occur on the display panel.

The above information disclosed in this Background section is only for understanding of the background of the inventive concepts, and, therefore, it may contain information that does not constitute prior art.

SUMMARY

Embodiments of the invention provide a pixel circuit in which a sufficient voltage may be provided to a light emitting element to reduce an image quality defect of a display panel.

Embodiments of the invention also provide a display device including the pixel circuit.

Embodiments of the invention also provide a method of driving the pixel circuit.

Additional features of the inventive concepts will be set forth in the description which follows, and in part will be apparent from the description, or may be learned by practice of the inventive concepts.

An embodiment of the invention provides a pixel circuit including an organic light emitting diode, a first transistor configured to drive the organic light emitting diode, a second transistor electrically connected between a gate node of the first transistor and a data line, a third transistor electrically connected between a source node of the first transistor and an initialization voltage line, and a storage capacitor electrically connected between the gate node and the source node of the first transistor. In a data writing period in which the storage capacitor is charged with electric charges, a turn-off time of the third transistor lags compared to a turn-off time of the second transistor.

In the data writing period, a turn-on start time of the third transistor is same as a turn-on start time of the second transistor.

The second transistor and the third transistor are connected to mutually different gate lines.

The second transistor is controlled by a scan signal, and the third transistor is controlled by an initialization signal.

A time at which the initialization signal has a turn-on level is the same as a time at which the scan signal has a turn-on level.

A period in which the initialization signal has a turn-on level is longer than a period in which the scan signal has a turn-on level.

In a period in which the scan signal is switched from a turn-on level to a turn-off level, a voltage of the storage capacitor is constantly maintained.

In a period in which the initialization signal is switched from a turn-on level to a turn-off level, a voltage of the storage capacitor is constantly maintained.

Another embodiment of the invention provides a display device including a display panel including a plurality of pixel circuits, a gate driver configured to output a gate signal to the display panel, a data driver configured to output a data voltage to the display panel and a driving controller configured to control operations of the gate driver and the data driver. The pixel circuit includes an organic light emitting diode, a first transistor configured to drive the organic light emitting diode, a second transistor electrically connected between a gate node of the first transistor and a data line, a third transistor electrically connected between a source node of the first transistor and an initialization voltage line, and a storage capacitor electrically connected between the gate node and the source node of the first transistor. In a data writing period in which the storage capacitor is charged with electric charges, a turn-off time of the third transistor lags compared to a turn-off time of the second transistor.

In the data writing period, a turn-on start time of the third transistor is same as a turn-on start time of the second transistor.

The second transistor and the third transistor are connected to mutually different gate lines.

The second transistor is controlled by a scan signal, and the third transistor is controlled by an initialization signal.

A time at which the initialization signal has a turn-on level is the same as a time at which the scan signal has a turn-on level.

A period in which the initialization signal has a turn-on level is longer than a period in which the scan signal has a turn-on level.

In a period in which the scan signal is switched from a turn-on level to a turn-off level, a voltage of the storage capacitor is constantly maintained.

In a period in which the initialization signal is switched from a turn-on level to a turn-off level, a voltage of the storage capacitor is constantly maintained.

Another embodiment of the invention provides a method of driving a pixel circuit including charging a storage capacitor with electric charges, maintaining a voltage of the storage capacitor and emitting light through an organic light emitting diode based on the voltage of the storage capacitor.

When the charging of the storage capacitor with the electric charges is completed, the voltage of the storage capacitor is constantly maintained.

A turn-on start time of a second transistor electrically connected between a gate node of a first transistor and a data line is same as a turn-on start time of a third transistor electrically connected between a source node of the first transistor and an initialization voltage line.

A turn-off time of the third transistor lags compared to a turn-off time of the second transistor.

The second transistor is controlled by a scan signal, and the third transistor is controlled by an initialization signal.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
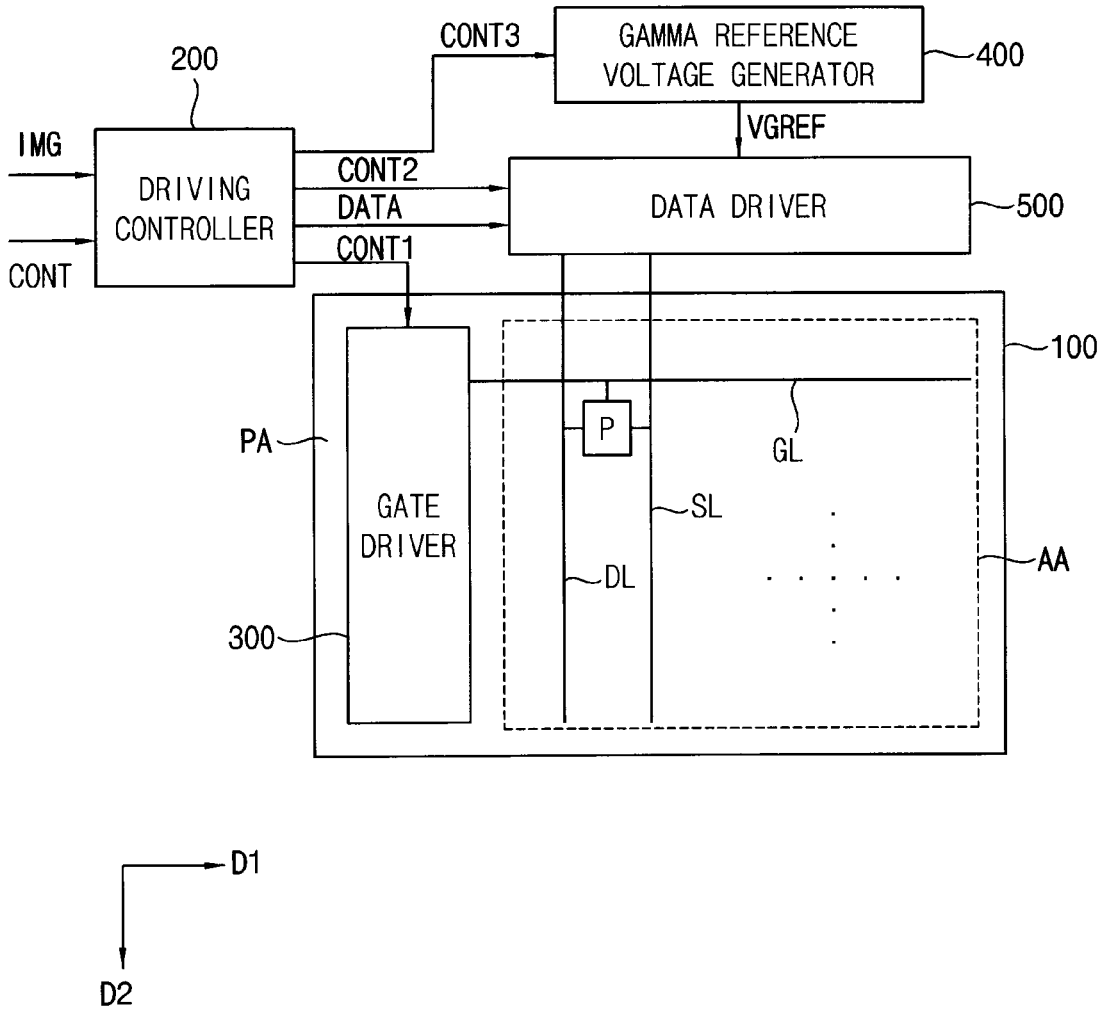
FIG. 1 is a block diagram illustrating a display device according to an embodiment of the present inventive concept.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath"

other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, the present inventive concept will be described in more detail with reference to the accompanying drawings.

FIG. 1 is a block diagram illustrating a display device according to an embodiment of the present inventive concept.

Referring to FIG. 1, a display device may include a display panel 100 and a display panel driver. The display panel driver may include a driving controller 200, a gate driver 300, a gamma reference voltage generator 400, and a data driver 500.

For example, the driving controller 200 and the data driver 500 may be integrally formed. For example, the driving controller 200, the gamma reference voltage generator 400, and the data driver 500 may be integrally formed. A driving module in which at least the driving controller 200 and the data driver 500 are integrally formed may be referred to as a timing controller-embedded data driver (TED).

The display panel 100 may include a display area AA for displaying an image and a peripheral area PA adjacent to the display area.

For example, in the present embodiment, the display panel 100 may be an organic light emitting diode display panel including an organic light emitting diode. Alternatively, the display panel 100 may be a liquid crystal panel including a liquid crystal layer.

The display panel 100 may include a plurality of gate lines GL, a plurality of data lines DL, and a plurality of pixels P electrically connected to the gate lines GL and the data lines DL, respectively. The gate lines GL may extend in a first direction D1, and the data lines DL may extend in a second direction D2 intersecting the first direction D1.

The driving controller 200 may receive input image data IMG and an input control signal CONT from an external device (not shown). For example, the input image data IMG may include red image data, green image data, and blue image data. The input image data IMG may include white image data. The input image data IMG may include magenta image data, yellow image data, and cyan image data. The input control signal CONT may include a master clock signal and a data enable signal. The input control signal CONT may further include a vertical synchronization signal and a horizontal synchronization signal.

The driving controller 200 may generate a first control signal CONT1, a second control signal CONT2, a third control signal CONT3, and a data signal DATA based on the input image data IMG and the input control signal CONT.

The driving controller 200 may generate the first control signal CONT1 for controlling an operation of the gate driver 300 based on the input control signal CONT to output the generated first control signal CONT1 to the gate driver 300. The first control signal CONT1 may include a vertical start signal and a gate clock signal.

The driving controller 200 may generate the second control signal CONT2 for controlling an operation of the data driver 500 based on the input control signal CONT to output the generated second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT to output the generated third control signal CONT3 to the gamma reference voltage generator 400.

The gate driver 300 may generate gate signals for driving the gate lines GL in response to the first control signal CONT1 received from the driving controller 200. The gate driver 300 may output the gate signals to the gate lines GL. For example, the gate driver 300 may sequentially output the gate signals to the gate lines GL.

In the present embodiment, the gate driver 300 may be integrated on the peripheral area PA of the display panel.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF has a value corresponding to each data signal DATA.

In an embodiment of the present inventive concept, the gamma reference voltage generator 400 may be disposed in the driving controller 200 or the data driver 500.

The data driver 500 may receive the second control signal CONT2 and the data signal DATA from the driving controller 200, and may receive the gamma reference voltage VGREF from the gamma reference voltage generator 400. The data driver 500 may convert the data signal DATA into an analog data voltage by using the gamma reference voltage VGREF. The data driver 500 may output the data voltage to the data line DL.

Figure 2:
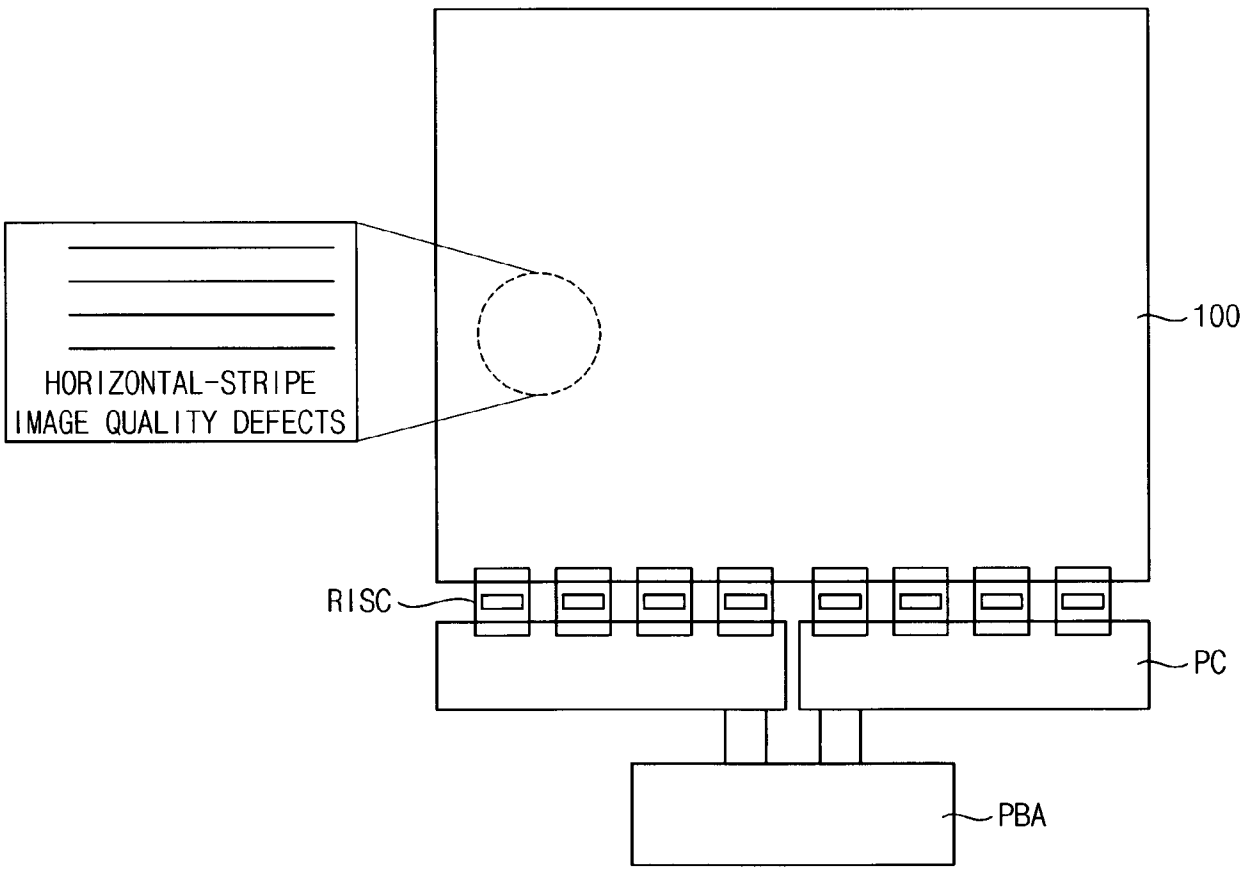
FIG. 2 is a plan view illustrating the display device of FIG. 1.

FIG. 2 is a plan view illustrating the display device of FIG. 1.

Referring to FIGS. 1 and 2, the display device may include a printed circuit board assembly PBA and a printed circuit PC. The printed circuit board assembly PBA may be connected to the printed circuit PC. For example, the driving controller 200 may be disposed in the printed circuit board assembly PBA.

The display device may include a plurality of flexible circuits FP connected to the printed circuit PC and the display panel 100.

A plurality of readout chips RSIC of the data driver 500 may be disposed in the flexible circuits FP. The readout chip RSIC may be an integrated circuit chip.

A transistor in each of the pixels P on the display panel 100 may not be sufficiently charged because of a signal transmission error caused by an RC delay and a clock jitter (CK jitter) inside a circuit of the pixel P. In this case, a light emitting element inside the pixel circuit may not sufficiently emit light, so that a horizontal-stripe image quality defect phenomenon may occur as shown in FIG. 2. The configuration of the pixel circuit according to the inventive concepts to prevent such a horizontal-stripe image quality defect phenomenon will be described below with reference to FIGS. 3 to 6.

Figure 3:
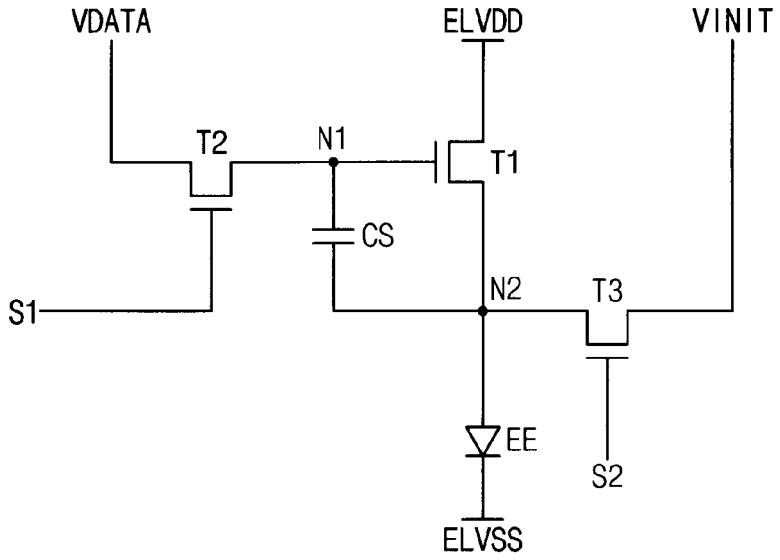
FIG. 3 is a circuit diagram illustrating a pixel of FIG. 1.
Figure 4:
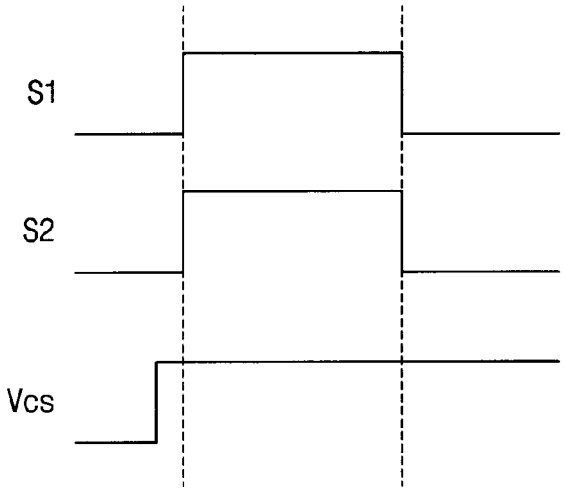
FIG. 4 is a timing diagram illustrating gate signals and a charging voltage of the pixel of FIG. 3.

FIG. 3 is a circuit diagram illustrating a pixel P of FIG. 1. FIG. 4 is a timing diagram illustrating gate signals S1 and S2 and a charging voltage Vcs of the pixel P of FIG. 3.

Referring to FIGS. 1 to 4, the pixel circuit disposed in the organic light emitting diode display device 100 according to the present inventive concept may include at least one transistor and at least one capacitor, and a light emitting element EE may be disposed in the pixel circuit as a light emitting element. For example, the pixel circuit may include a first transistor T1, a second transistor T2, a third transistor T3, a storage capacitor CS, and a light emitting element EE. In this case, an on-off state of the second transistor T2 may be controlled by applying a scan signal S1 to a gate node of the second transistor T2 through a corresponding gate line, and an on-off state of the third transistor T3 may be controlled by applying an initialization signal S2, which is different from the scan signal S1, to a gate node of the third transistor T3 through a corresponding gate line.

The first transistor T1 may include a first node N1 and a second node N2. The first node N1 of the first transistor T1 may be a gate node to which a data voltage VDATA is applied through the data line DL when the second transistor T2 is turned on. The second node N2 of the first transistor T1 may be electrically connected to an anode electrode of the light emitting element EE, and may be a source node or a drain node. In this case, a driving voltage ELVDD required for image driving may be supplied in an image driving period. For example, the driving voltage ELVDD required for the image driving may be 25 V.

The second transistor T2 may be electrically connected between the first node N1 of the first transistor T1 and the data line DL, and the gate line GL may be connected to the gate node of the second transistor T2 so that the second transistor T2 may operate according to the scan signal S1 supplied through the gate line GL. In addition, when the second transistor T2 is turned on, the data voltage VDATA supplied through the data line DL may be transmitted to the gate node of the first transistor T1, so that an operation of the first transistor T1 may be controlled.

The third transistor T3 may be electrically connected between the second node N2 of the first transistor T1 and an initialization voltage line, and the gate line GL may be connected to the gate node of the third transistor T3 so that the third transistor T3 may operate according to the initialization signal S2 supplied through the gate line GL. When the third transistor T3 is turned on, an initialization voltage VINIT supplied through the initialization voltage line may be transmitted to the second node N2 of the first transistor T1. In other words, voltages of the first and second nodes N1 and N2 of the first transistor T1 may be controlled by controlling the second transistor T2 and the third transistor T3, so that a current for driving the light emitting element EE may be supplied.

The second transistor T2 and the third transistor T3 may be connected to the same gate line GL, or may be connected to mutually different gate lines GL. In the present embodiment, a structure in which the second transistor T2 and the third transistor T3 are connected to mutually different gate lines GL has been illustrated. In this case, the second transistor T2 and the third transistor T3 may be controlled by the scan signal S1 and the initialization signal S2 transmitted through the gate lines GL, respectively.

A transistor disposed in the pixel circuit may be an n-type transistor or a p-type transistor. In the present embodiment, a case in which the pixel circuit includes the n-type transistor has been illustrated.

The storage capacitor CS may be electrically connected between the first node N1 and the second node N2 of the first transistor T1, and may maintain the data voltage VDATA during one frame.

The storage capacitor CS may be connected between the first node N1 and a second node N2 of the first transistor T1 depending on a type of the first transistor T1. The anode electrode of the light emitting element EE may be electrically connected to the second node N2 of the first transistor T1, and a base voltage ELVSS may be applied to a cathode electrode of the light emitting element EE. In this case, the base voltage ELVSS may be a ground voltage or a voltage that is higher or lower than the ground voltage. In addition, the base voltage ELVSS may vary according to a driving state. For example, a base voltage ELVSS at an image driving time and a base voltage ELVSS at a sensing driving time may be set differently from each other.

The structure of the pixel circuit illustrated above is a 3T (transistor)-1C (capacitor) structure, but this is only an example for description. Accordingly, the pixel circuit may further include at least one transistor, or in some cases, the pixel circuit may further include at least one capacitor. Alternatively, a plurality of pixel circuits may have the same structure, and some of the pixel circuits may have a different structure.

The image driving that allows the pixel circuit to emit light may be performed through a data writing period, a boosting period, and an emission period.

In the data writing period, an image-driving data voltage VDATA corresponding to an image signal may be applied to the first node N1 of the first transistor T1, and the initialization voltage VINIT may be applied to the second node N2 of the first transistor T1. In this case, due to a resistance component or the like between the second node N2 of the first transistor T1 and the initialization voltage line, a voltage similar to the initialization voltage VINIT may be applied to the second node N2 of the first transistor T1. In the data writing period, the storage capacitor CS may be charged with electric charges corresponding to a potential difference across the storage capacitor CS (VDATA−VINIT). Such a voltage across the storage capacitor may be defined as a charging voltage Vcs.

Referring to FIG. 4, at a start time of the data writing period, the scan signal S1 and the initialization signal S2 may be simultaneously turned on. In other words, in the data writing period, a turn-on start time of the third transistor T3 may be the same as a turn-on start time of the second transistor T2.

Data writing refers to an operation of applying the image-driving data voltage VDATA to the first node N1 of the first transistor T1. In a boosting period after the data writing period, the first node N1 and the second node N2 of the first transistor T1 may be electrically floated. To this end, the second transistor T2 may be turned off by the scan signal S1 having a turn-off level. In addition, the third transistor T3 may be turned off by the initialization signal S2 having a turn-off level. Referring to FIG. 4, at a start time of the boosting period, the scan signal S1 and the initialization signal S2 may be simultaneously turned off. In other words, in the boosting period, a turn-off start time of the third transistor T3 may be the same as a turn-off start time of the second transistor T2.

In the boosting period, as a voltage difference between the first node N1 and the second node N2 of the first transistor T1 is maintained, a voltage of each of the first node N1 and the second node N2 of the first transistor T1 may be boosted. Through the boosting period, the voltages of the first node N1 and the second node N2 of the first transistor T1 may be boosted, and when the voltage of the second node N2 of the first transistor T1 reaches a predetermined voltage, that is, a voltage capable of turning on the light emitting element EE, the process enters the emission period.

In the emission period, a driving current may flow through the light emitting element EE, so that the light emitting element EE may emit light. In this case, the first transistor T1 disposed in the pixel circuits may have a unique characteristic value, such as a threshold voltage and mobility. However, since the first transistor T1 may deteriorate according to a driving time, the unique characteristic value of the first transistor T1 may vary according to the driving time.

Figure 5A:
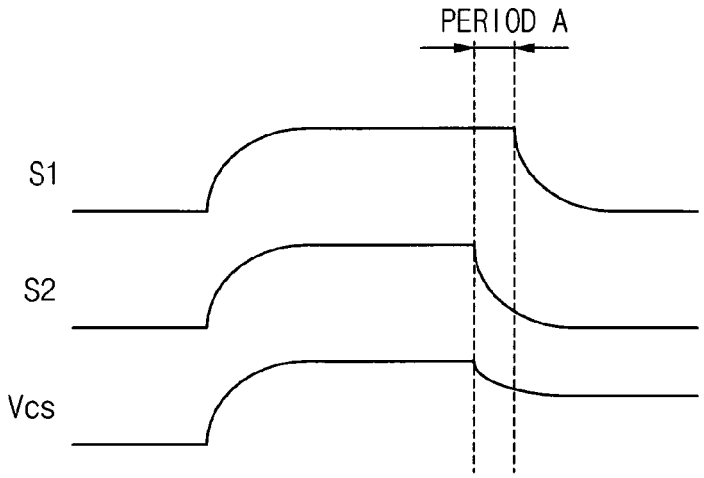
FIGS. 5A and 5B are a timing diagram illustrating an input signal and an output signal of a pixel and a circuit diagram of the pixel upon actual driving, respectively.
Figure 5B:
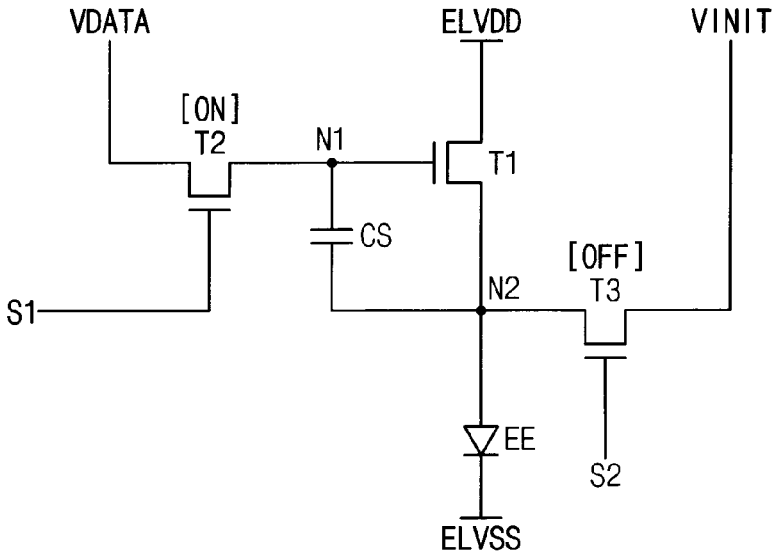
Figure 6A:
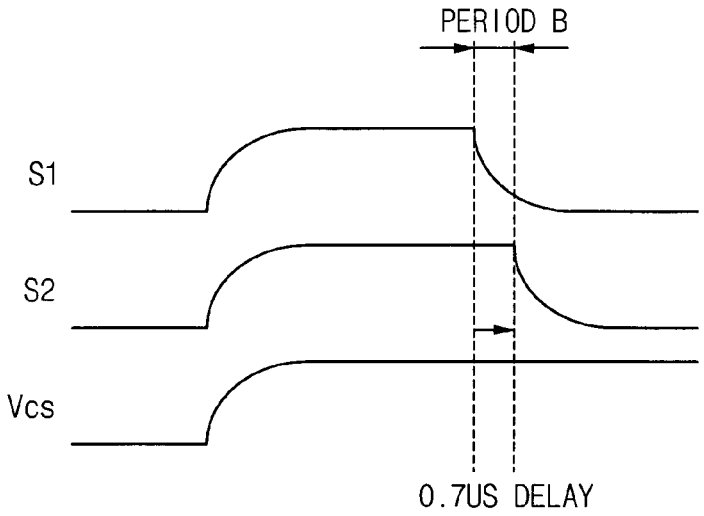
FIGS. 6A and 6B are a timing diagram illustrating an input signal and an output signal of the pixel and a circuit diagram of the pixel according to an embodiment of the present inventive concept, respectively.
Figure 6B:
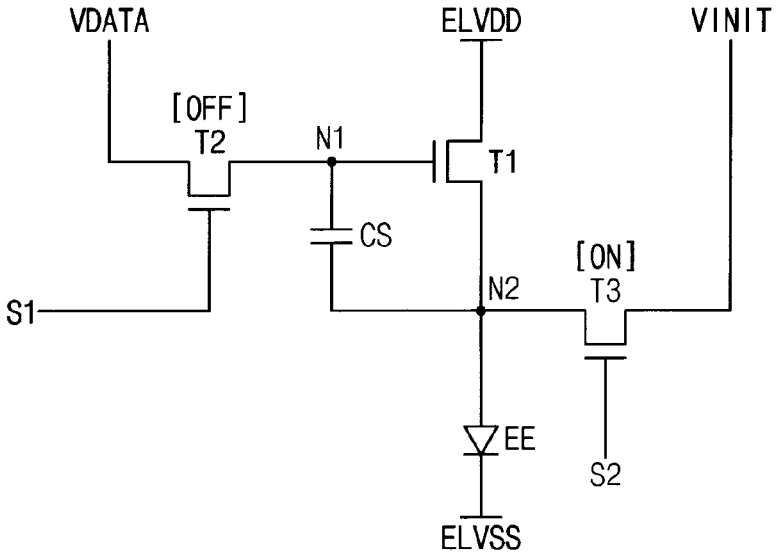

FIGS. 5A and 5B are a timing diagram illustrating an input signal and an output signal of a pixel and a circuit diagram of the pixel upon actual driving, respectively. FIGS. 6A and 6B are a timing diagram illustrating an input signal and an output signal of the pixel and a circuit diagram of the pixel according to an embodiment of the present inventive concept, respectively.

In the data writing period, the image-driving data voltage VDATA corresponding to the image signal may be applied to the first node N1 of the first transistor T1, and the initialization voltage VINIT may be applied to the second node N2 of the first transistor T1. In this case, due to the resistance component or the like between the second node N2 of the first transistor T1 and the initialization voltage line, the voltage similar to the initialization voltage VINIT may be applied to the second node N2 of the first transistor T1. In the data writing period, the storage capacitor CS may be charged with electric charges corresponding to the potential difference across the storage capacitor CS (VDATA−VINIT). Such a voltage across the storage capacitor may be defined as the charging voltage Vcs.

Referring to FIG. 5A, the second transistor T2 may be controlled by the scan signal S1, and the third transistor T3 may be controlled by the initialization signal S2. At the start time of the data writing period, the scan signal S1 and the initialization signal S2 may be simultaneously turned on. In other words, in the data writing period, the turn-on start time of the third transistor T3 may be the same as the turn-on start time of the second transistor T2.

The data writing refers to the operation of applying the image-driving data voltage VDATA to the first node N1 of the first transistor T1. In the boosting period after the data writing period, the first node N1 and the second node N2 of the first transistor T1 may be electrically floated. To this end, the second transistor T2 may be turned off by the scan signal S1 having the turn-off level. In addition, the third transistor T3 may be turned off by the initialization signal S2 having the turn-off level.

Referring to FIG. 5A, at the start time of the boosting period, the scan signal S1 and the initialization signal S2 may be simultaneously turned off. In other words, in the boosting period, the turn-off start time of the third transistor T3 may be the same as the turn-off start time of the second transistor T2.

A time delay may occur in the scan signal S1 and the initialization signal S2 applied to each of the pixel circuits due to an RC delay and a clock jitter (CK jitter). When the time delay occurs, the initialization signal S2 may be turned off earlier than the scan signal S1. As shown in FIG. 5A, when the initialization signal S2 is turned off earlier than the scan signal S1, a magnitude of the charging voltage Vcs may be gradually decreased without being maintained during a period A. As shown in FIG. 5B, in the period A, the second transistor may be turned on, and the third transistor may be turned off. When the second transistor is turned on, and the third transistor is turned off, a leakage current may be generated inside the pixel circuit, so that the charging voltage Vcs may be gradually decreased. In other words, at the start time of the boosting period, the magnitude of the charging voltage Vcs may be gradually decreased, so that the light emitting element EE may not sufficiently emit the light in the emission period. In this case, as shown in FIG. 2, the horizontal-stripe image quality defect phenomenon may occur.

In order to prevent the generation of the leakage current inside the pixel circuit caused by such a time delay, according to the present inventive concept, the pixel circuit may be configured such that the initialization signal S2 is turned off later than the scan signal S1 at the start time of the boosting period. In other words, as shown in FIG. 6A, in the boosting period, the turn-off start time of the third transistor T3 may lag compared to the turn-off start time of the second transistor T2. As shown in FIG. 6A, the initialization signal S2 may be turned off later than the scan signal S1 by 0.7 μs. However, this is only an example of the initialization signal S2, so that a specific difference in turn-off times may vary according to each transistor and characteristics such as a signal type. As shown in FIG. 6A, when the initialization signal S2 is turned off later than the scan signal S1, the magnitude of the charging voltage Vcs may be maintained as in a period B. As shown in FIG. 6B, in the period B, the second transistor may be turned off, and the third transistor may be turned on. When the second transistor is turned off, and the third transistor is turned on, the leakage current may not be generated inside the pixel circuit, so that the charging voltage Vcs may be constantly maintained. In other words, at the start time of the boosting period, the magnitude of the charging voltage Vcs may be maintained, so that the light emitting element EE may sufficiently emit the light in the emission period. As described above, when the initialization signal S2 is turned off later than the scan signal S1, the horizontal-stripe image quality defect phenomenon of the display panel 100 caused by insufficient charging of the light emitting element EE may be prevented.

Figure 7:
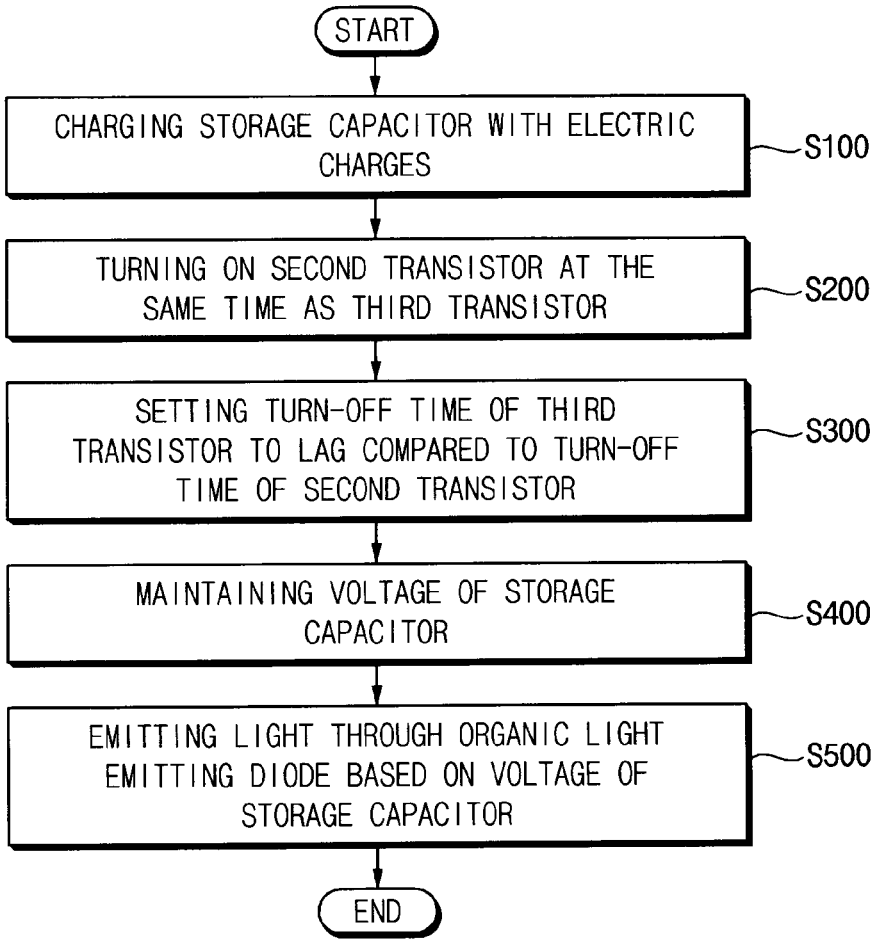
FIG. 7 is a flowchart illustrating an operation of the display device according to an embodiment of the present inventive concept.

FIG. 7 is a flowchart illustrating an operation of the display device according to an embodiment of the present inventive concept.

Referring to FIGS. 3 to 7, the pixel circuit may charge the storage capacitor CS with electric charges (S100); turn on the second transistor T2 at the same time as the third transistor T3 (S200); set a turn-off time of the third transistor T3 to lag compared to a turn-off time of the second transistor T2 (S300); maintain a voltage of the storage capacitor CS (S400); and emit light through the light emitting element EE based on the voltage of the storage capacitor CS (S500).

In an embodiment, the pixel circuit may charge the storage capacitor CS with electric charges (S100). In detail, in the data writing period, the image-driving data voltage VDATA corresponding to the image signal may be applied to the first node N1 of the first transistor T1, and the initialization voltage VINIT may be applied to the second node N2 of the first transistor T1. In this case, due to the resistance component or the like between the second node N2 of the first transistor T1 and the initialization voltage line, the voltage similar to the initialization voltage VINIT may be applied to the second node N2 of the first transistor T1. In the data writing period, the storage capacitor CS may be charged with electric charges corresponding to the potential difference across the storage capacitor CS (VDATA–VINIT). Such a voltage across the storage capacitor may be defined as the charging voltage Vcs.

In an embodiment, the pixel circuit may turn on the second transistor T2 at the same time as the third transistor T3 (S200). In detail, at the start time of the data writing period, the scan signal S1 and the initialization signal S2 may be simultaneously turned on. In other words, in the data writing period, the turn-on start time of the third transistor T3 may be the same as the turn-on start time of the second transistor T2. The data writing refers to the operation of applying the image-driving data voltage VDATA to the first node N1 of the first transistor T1.

In an embodiment, the pixel circuit may set the turn-off time of the third transistor T3 to lag compared to the turn-off time of the second transistor T2 (S300); maintain the voltage of the storage capacitor CS (S400); and emit the light through the light emitting element EE based on the voltage of the storage capacitor CS (S500). In detail, in the boosting period after the data writing period, the first node N1 and the second node N2 of the first transistor T1 may be electrically floated. To this end, the second transistor T2 may be turned off by the scan signal S1 having the turn-off level. In addition, the third transistor T3 may be turned off by the initialization signal S2 having the turn-off level.

The time delay may occur in the scan signal S1 and the initialization signal S2 applied to each of the pixel circuits due to the RC delay and the clock jitter (CK jitter). When the time delay occurs, the initialization signal S2 may be turned off earlier than the scan signal S1. When the initialization signal S2 is turned off earlier than the scan signal S1, the magnitude of the charging voltage Vcs may be gradually decreased without being maintained, as in the period A. When the second transistor is turned on, and the third transistor is turned off, the leakage current may be generated inside the pixel circuit, so that the charging voltage Vcs may be gradually decreased. In other words, at the start time of the boosting period, the magnitude of the charging voltage Vcs may be gradually decreased, so that the light emitting element EE may not sufficiently emit the light in the emission period.

Therefore, in order to prevent the generation of the leakage current inside the pixel circuit caused by such a time delay, according to the present inventive concept, the pixel circuit may be configured such that the initialization signal S2 is turned off later than the scan signal S1 at the start time of the boosting period. When the initialization signal S2 is turned off later than the scan signal S1, the magnitude of the charging voltage Vcs may be maintained, as in the period B. When the second transistor is turned off, and the third transistor is turned on, the leakage current may not be generated inside the pixel circuit, so that the charging voltage Vcs may be constantly maintained. For example, in a period in which the scan signal S1 is switched from a turn-on level to the turn-off level, the magnitude of the charging voltage Vcs may be constantly maintained. As another example, in a period in which the initialization signal S2 is switched from a turn-on level to the turn-off level, the magnitude of the charging voltage Vcs may be constantly maintained. In other words, at the start time of the boosting period, the magnitude of the charging voltage Vcs may be maintained, so that the light emitting element EE may sufficiently emit the light in the emission period. As described above, when the initialization signal S2 is turned off later than the scan signal S1, the horizontal-stripe image quality defect phenomenon of the display panel 100 caused by the insufficient charging of the light emitting element EE may be prevented.

Figure 8:
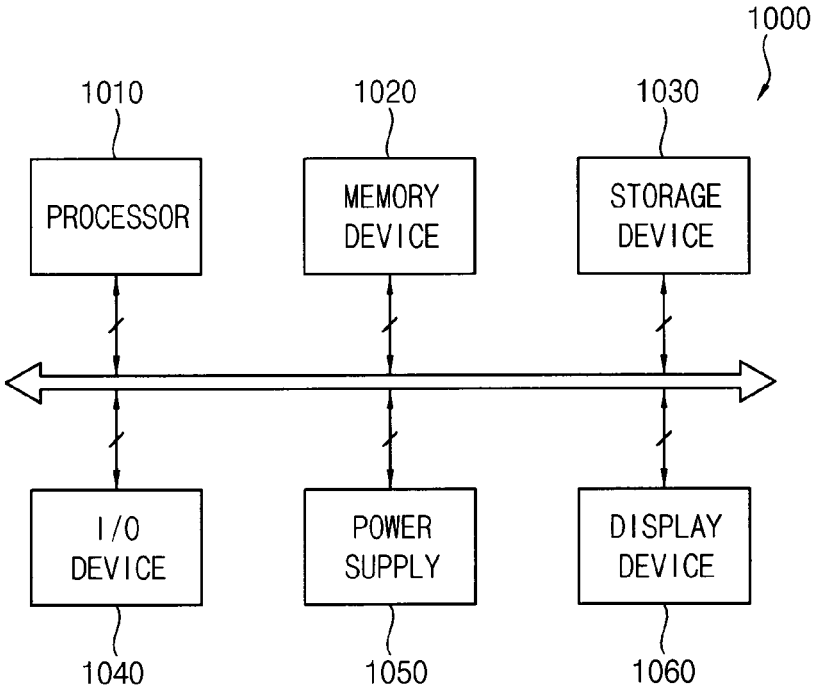
FIG. 8 is a block diagram illustrating an electronic device according to embodiments of the present inventive concept.
Figure 9:
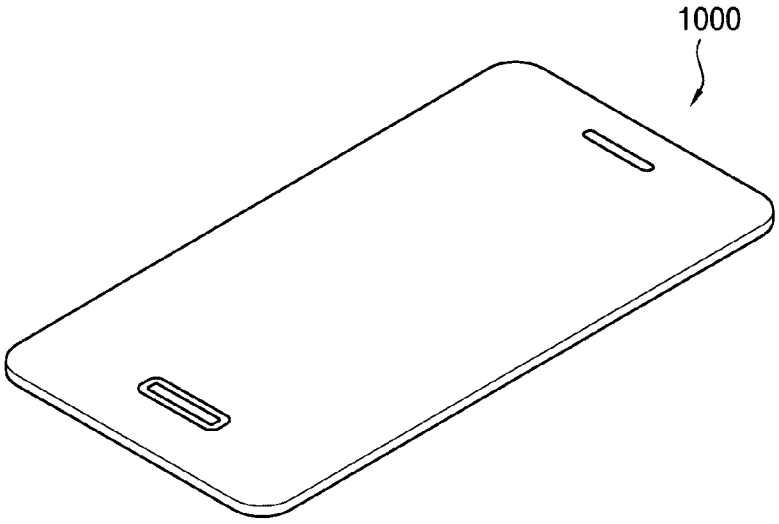
FIG. 9 is a diagram illustrating one example in which the electronic device of FIG. 8 is implemented as a smartphone.

FIG. 8 is a block diagram illustrating an electronic device according to the embodiments of the present inventive concept. FIG. 9 is a diagram illustrating an example in which the electronic device of FIG. 8 is implemented as a smart phone.

Referring to FIGS. 8 and 9, the electronic device 1000 may include a processor 1010, a memory device 1020, a storage device 1030, an input/output (I/O) device 1040, a power supply 1050, and a display device 1060. In addition, the electronic device 1000 may further include a plurality of ports for communicating with a video card, a sound card, a memory card, a universal serial bus (USB) device, other electronic device, and the like. In an embodiment, as illustrated in FIG. 9, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, and the like.

The processor 1010 may perform various computing functions. The processor 1010 may be a micro processor, a central processing unit (CPU), an application processor (AP), and the like. The processor 1010 may be coupled to other components via an address bus, a control bus, a data bus, and the like. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and the like and/or at least one volatile memory device such as a dynamic random access memory (DRAM) device, a static random access memory (SRAM) device, a mobile DRAM device, and the like. The storage device 1030 may include a solid state drive (SSD) device, a hard disk drive (HDD) device, a CD-ROM device, and the like. The I/O device 1040 may include an input device such as a keyboard, a keypad, a mouse device, a touch-pad, a touch-screen, and the like, and an output device such as a printer, a speaker, and the like. In some embodiments, the I/O device 1040 may include the display device 1060. The power supply 1050 may provide power for operations of the electronic device 1000.

The display device 1060 may display an image corresponding to visual information of the electronic device 1000. The display device 1060 may include a display panel including a plurality of pixel circuits, a gate driver configured to output a gate signal to the display panel, a data driver configured to output a data voltage to the display panel and a driving controller configured to control operations of the gate driver and the data driver. The pixel circuit may include an organic light emitting diode, a first transistor configured to drive the organic light emitting diode, a second transistor electrically connected between a gate node of the first transistor and a data line, a third transistor electrically connected between a source node of the first transistor and an initialization voltage line and a storage capacitor electrically connected between the gate node and the source node of the first transistor. In a data writing period in which the storage capacitor is charged with electric charges, a turn-off time of the third transistor lags compared to a turn-off time of the second transistor. According to the pixel circuit, the display device including the same, and the method of driving the pixel circuit as described above, the initialization signal is turned off later than the scan signal, so that a magnitude of a charging voltage can be maintained, and thus the light emitting element can sufficiently emit light in an emission period. Therefore, a horizontal-stripe image quality defect phenomenon of the display panel caused by insufficient charging of the light emitting element can be prevented. However, since these are described above, duplicated descriptions related thereto will not be repeated.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A pixel circuit comprising:

an organic light emitting diode;

a first transistor configured to drive the organic light emitting diode;

a second transistor electrically connected between a gate node of the first transistor and a data line configured to carry a data voltage corresponding to a data signal generated based on input image data and an input control signal;

a third transistor electrically connected between a source node of the first transistor and an initialization voltage line; and a storage capacitor electrically connected between the gate node and the source node of the first transistor, wherein:

in a data writing period in which the storage capacitor is charged with electric charges, a turn-off time of the third transistor lags compared to a turn-off time of the second transistor;

the second transistor is controlled by a scan signal; and in a period in which the scan signal is switched from a turn-on level to a turn-off level, a voltage of the storage capacitor is constantly maintained.

2. The pixel circuit of claim 1, wherein, in the data writing period, a turn-on start time of the third transistor is the same as a turn-on start time of the second transistor.

3. The pixel circuit of claim 2, wherein;

the third transistor is controlled by an initialization signal.

4. The pixel circuit of claim 3, wherein a time at which the initialization signal has a turn-on level is the same as a time at which the scan signal has a turn-on level.

5. The pixel circuit of claim 3, wherein a period in which the initialization signal has a turn-on level is longer than a period in which the scan signal has a turn-on level.

6. The pixel circuit of claim 3, wherein, in a period in which the initialization signal is switched from a turn-on level to a turn-off level, a voltage of the storage capacitor is constantly maintained.

7. The pixel circuit of claim 2, wherein the second transistor and the third transistor are connected to mutually different gate lines.

8. A display device comprising:

a display panel including a plurality of pixel circuits;

a gate driver configured to output a gate signal to the display panel;

a data driver configured to output a data voltage to the display panel; and a driving controller configured to control operations of the gate driver and the data driver, wherein the pixel circuit includes:

an organic light emitting diode;

a first transistor configured to drive the organic light emitting diode;

a second transistor electrically connected between a gate node of the first transistor and a data line configured to carry a data voltage corresponding to a data signal generated based on image data and a control signal input to the driving controller;

a third transistor electrically connected between a source node of the first transistor and an initialization voltage line; and a storage capacitor electrically connected between the gate node and the source node of the first transistor;

in a data writing period in which the storage capacitor is charged with electric charges, a turn-off time of the third transistor lags compared to a turn-off time of the second transistor;

the second transistor is controlled by a scan signal; and in a period in which the scan signal is switched from a turn-on level to a turn-off level, a voltage of the storage capacitor is constantly maintained.

9. The display device of claim 8, wherein, in the data writing period, a turn-on start time of the third transistor is the same as a turn-on start time of the second transistor.

10. The display device of claim 9, wherein;

the third transistor is controlled by an initialization signal.

11. The display device of claim 10, wherein a time at which the initialization signal has a turn-on level is the same as a time at which the scan signal has a turn-on level.

12. The display device of claim 10, wherein a period in which the initialization signal has a turn-on level is longer than a period in which the scan signal has a turn-on level.

13. The display device of claim 10, wherein, in a period in which the initialization signal is switched from a turn-on level to a turn-off level, a voltage of the storage capacitor is constantly maintained.

14. The display device of claim 9, wherein the second transistor and the third transistor are connected to mutually different gate lines.

* * * * *